US005823543A

United States Patent [19]

Burns et al.

[11] Patent Number: 5,823,543

[45] Date of Patent: Oct. 20, 1998

[54] ROLLER SKATE SHOCK ABSORBER SYSTEM

[75] Inventors: Clay Allen Burns, Boston; Peter Madelaire Nielsen, Quincy, both of Mass.; John Aloysius Sullivan; Frederick Ballou-Viaux Sullivan, both of 53 Old Sudbury Rd., Wayland, Mass. 01778

[73] Assignees: John Aloysius Sullivan; Frederick Ballou-Viaux Sullivan, both of Wayland, Mass.

[21] Appl. No.: 584,187

[22] Filed: Jan. 11, 1996

[51] Int. Cl.[6] ..... A63C 17/02

[52] U.S. Cl. ..... 280/11.22; 280/11.28; 280/716

[58] Field of Search ..... 280/11.22, 11.28, 280/11.27, 688, 716

[56] References Cited

U.S. PATENT DOCUMENTS

| | | | |
|---|---|---|---|
| 47,682 | 5/1865 | Murray . | |
| 181,868 | 9/1876 | Saladee . | |
| 240,970 | 5/1881 | Cornelius . | |
| 253,784 | 2/1882 | Tapper . | |
| 259,708 | 6/1882 | Neely . | |
| 296,358 | 4/1884 | Rowlett . | |
| 298,721 | 5/1884 | Bailey . | |
| 304,949 | 9/1884 | Mitchell . | |
| 320,626 | 6/1885 | Castle . | |
| 566,694 | 8/1896 | Libbey . | |
| 604,179 | 5/1898 | Sulke . | |
| 829,900 | 8/1906 | Shelmire . | |
| 893,341 | 7/1908 | Martinsen . | |
| 1,208,173 | 12/1916 | Lenhardt . | |
| 1,640,134 | 8/1927 | Salberg . | |
| 1,700,058 | 1/1929 | Katuby . | |
| 1,771,855 | 7/1930 | MacMillan . | |
| 2,429,678 | 10/1947 | Fuller | 280/11.28 |
| 2,461,057 | 2/1949 | Hirschman . | |
| 2,470,840 | 5/1949 | Anz . | |
| 2,535,887 | 12/1950 | Biddle . | |
| 2,537,213 | 1/1951 | De Vault . | |
| 2,552,987 | 5/1951 | Loertz, Jr. . | |
| 2,553,450 | 5/1951 | Fuller | 280/11.28 |
| 2,664,294 | 12/1953 | Kleinman . | |
| 2,696,989 | 12/1954 | Kleinman . | |
| 3,339,936 | 9/1967 | Hamlin | 280/11.22 |
| 3,653,678 | 4/1972 | Collett | 280/11.23 |
| 3,774,924 | 11/1973 | Machatsch | 280/11.28 |
| 4,058,323 | 11/1977 | Ware, Jr. | 280/11.1 |
| 4,212,479 | 7/1980 | Yoshimoto | 280/11.28 |
| 4,272,090 | 6/1981 | Wheat | 280/11.22 |
| 4,272,091 | 6/1981 | Reid, Jr. | 280/11.28 |
| 4,373,736 | 2/1983 | Stumbaugh | 280/11.23 |
| 4,392,659 | 7/1983 | Yoshimoto | 280/11.23 |
| 4,411,442 | 10/1983 | Rills | 280/221 |
| 4,618,158 | 10/1986 | Liberkowski | 280/11.1 |
| 4,817,974 | 4/1989 | Bergeron | 280/11.2 |
| 4,822,038 | 4/1989 | Maag | 272/134 |

(List continued on next page.)

FOREIGN PATENT DOCUMENTS

| | | | |
|---|---|---|---|
| 2500317 | 2/1982 | France . | |
| 658092 | 3/1938 | Germany | 280/11.22 |
| 2728166 | 1/1979 | Germany . | |

*Primary Examiner*—Brian L. Johnson
*Assistant Examiner*—Jonathan E. Butts
*Attorney, Agent, or Firm*—Iandiorio & Teska

[57] ABSTRACT

A roller skate shock absorber system in at least two double pivot mechanisms spaced longitudinally from front to back along a skate shoe; a truck device including a plurality of wheels interconnected with the double pivot mechanisms; each of the double pivot mechanisms including a first pivot mounted to the skate shoe, a pivot member rotatably connected to the first pivot and having a second pivot rotatably attached to the truck device; and at least one resilient member disposed between the skate shoe and the truck mechanism for biasing at least one of the pivot mechanisms with its first and second pivots generally vertically aligned to provide a firm push-off force.

10 Claims, 7 Drawing Sheets

U.S. PATENT DOCUMENTS

| | | | |
|---|---|---|---|
| 4,915,399 | 4/1990 | Marandel | 280/11.28 |
| 5,088,748 | 2/1992 | Koselka et al. | 280/11.2 |
| 5,100,161 | 3/1992 | Tillyer | 280/87.042 |
| 5,195,781 | 3/1993 | Osawa | 280/842 |
| 5,232,231 | 8/1993 | Carlsmith | 280/11.22 |
| 5,308,152 | 5/1994 | Ho | 301/5.3 |
| 5,342,071 | 8/1994 | Soo | 280/11.22 |
| 5,372,383 | 12/1994 | Kubierschky | 280/842 |
| 5,398,948 | 3/1995 | Mathis | 280/11.19 |
| 5,401,040 | 3/1995 | Grenko | 280/11.28 |
| 5,405,156 | 4/1995 | Gonella | 280/11.28 |
| 5,441,287 | 8/1995 | Tang | 280/11.28 |
| 5,582,418 | 12/1996 | Closser | 280/11.22 |

ROLLER SKATE SHOCK ABSORBER SYSTEM

FIELD OF INVENTION

This invention relates to a roller skate shock absorber system, and more particularly to such a system which provides both stiff and resilient suspension.

BACKGROUND OF INVENTION

As roller skating with both double wheel and in-line skates has become more popular as an exercise, as a fun sport and even for commuting, the need for a more versatile suspension system has grown and intensified. The growth of the in-line skate market has accelerated this need. In-line skates enable and encourage faster and more challenging skating. In many areas it is difficult to find a smooth skatable route which is long enough to satisfy an enthusiastic skater. This requires the skaters to endure rough roads and even to go off-road trail blazing to find the distance and challenge. Whether on rough roads or trail blazing, the rough bumpy terrain can be punishing to the muscles and joints, and dangerous too. While attempts have been made to soften the bumps, especially in in-line skates, using softer wheels, springs and the like, no suitable solution has been provided. The problem presents a dilemma. If the suspension is soft or springy enough to absorb shocks, then it tends to be too soft or sloppy in the push-off mode and if the suspension is stiff enough to enable efficient transfer of push-off force then there is not good shock absorption. In many cases the resilience in the suspension is provided by simple springs which do not truly absorb the shocks encountered on rough routes. A serious shortcoming of present skates is that they do not absorb well shocks from all directions—front, angled, and vertical, all of which can be encountered on rough and bumpy roads.

SUMMARY OF INVENTION

It is therefore an object of this invention to provide an improved roller skate shock absorber system which is both stiff for push-off and resilient for shock absorption.

It is a further object of this invention to provide such a roller skate shock absorber system which is inexpensive and simple to make and use.

It is a further object of this invention to provide such a roller skate shock absorber system which does not require special skate shoes or wheels.

It is a further object of this invention to provide such a roller skate shock absorber system which performs well on bumpy, loose and soft surfaces.

It is a further object of this invention to provide such a roller skate shock absorber system which absorbs front, angular and vertical impact.

The invention results from the realization that a truly effective shock absorbing system for a roller skate can be achieved with a structure that allows the wheels to absorb irregularities in the surface with a rocking motion with both vertical and horizontal components and more especially that the wheels can be pivotably suspended from the skate shoe with a double pivot four bar linkage in which at least one of the double pivot mechanisms are aligned vertically to provide the necessary stiffness for a vigorous push-off.

This invention features a roller skate shock absorber system having at least two double pivot mechanisms spaced longitudinally from front to back along a skate shoe. There is a truck device including a plurality of wheels interconnected with the double pivot mechanisms. Each of the double pivot mechanisms includes a first pivot mounted to the skate shoe, a pivot member rotatably connected to the first pivot and having a second pivot rotatably attached to the truck device. There is at least one resilient member disposed between the skate shoe and the truck mechanism for biasing at least one of the pivot mechanisms with its first and second pivots generally vertically aligned to provide a firm push-off force.

In a preferred embodiment there may only be two pivot mechanisms. The truck device may include a frame and a plurality of wheels rotatably mounted on the frame. The wheels may be arranged longitudinally in line. The resilient member may be disposed between the first pivot and its associated member and at least one of the pivot mechanisms, in two of the pivot mechanisms, or in all of the pivot mechanisms. There may be an adjustment device associated with each one of the resilient members for varying the stiffness response of the associated resilient member. The resilient member may include an elastomeric element. The truck device may include a plurality of independent wheel units. There may be pivot mechanisms interconnected with each wheel unit. The resilient member may be disposed behind the first and second pivots of its associated pivot mechanism. In at least one of the pivot mechanisms the pivot member may include stop means to limit forward rotation of the pivot member. There may be a control link pivotably attached to the pivot member of the forwardmost pivot mechanism and the pivot members of the following pivot mechanisms may each include guide members for enabling the control link to slide longitudinally. There may be a locking device on the pivot member of each following pivot mechanism for normally fixing the pivot members of the following pivot mechanisms to lock operation of the resilient member and releasing those pivot members when the forwardmost pivot member receives a shock. There may further be included locking means, selectively actuable, for locking the truck device in a fixed position with respect to the skate shoe.

The invention also features a roller skate shock absorber system which includes at least two mounting mechanisms spaced longitudinally from front to back along the skate shoe and a truck device having a plurality of wheels. Each mounting mechanism includes a first mounting member on the skate shoe, a second mounting member on the truck device, and a shock absorber member interposed between the first and second mounting members for absorbing shocks imparted to the wheels of the truck.

In a preferred embodiment the first and second mounting members may be angled vertically upwardly and rearwardly. One of the first and second mountings may include a salient element and the other a socket for slidably receiving the salient element. The shock absorber member may be disposed between the distal end of the element and the closed end of the socket. The shock absorber member may be an elastomeric medium. The truck device may include a frame and a plurality of wheels rotatably mounted on the frame. The wheels may be arranged longitudinally in line. The truck device may include a plurality of independent wheel units. There may be an adjustment mechanism mounted with at least one of the elastomeric members for varying the stiffness response of the elastomeric member. There may further be included locking means, selectively actuable, for locking the truck device in a fixed position with respect to the skate shoe.

The invention also features a roller skate shock absorber system having a truck device including a plurality of wheels and a pivot mechanism for interconnecting the truck device with the forward portion of the skate shoe. The shock absorber member interconnects the truck device with the rearward portion of the skate shoe.

In a preferred embodiment the shock absorber member may be connected between the back of the skate shoe and the truck device. The shock absorber member may be connected at an angle upwardly and rearwardly from the truck device to the bottom of the skate shoe or upwardly and forwardly from the truck device to the bottom of the skate shoe. There may further be included means for adjusting the angle of interconnection of the shock absorber between the truck device and the skate shoe to vary the stiffness of the shock absorber system. The truck device may include a frame and a plurality of wheels rotatably mounted on the frame. The wheels may be arranged longitudinally in line. There may be an adjustment device for varying the stiffness of the shock absorber member. There may further be included locking means, selectively actuable, for locking the truck device in a fixed position with respect to the skate shoe.

BRIEF DESCRIPTION OF THE DRAWINGS

Other objects, features and advantages will occur to those skilled in the art from the following description of a preferred embodiment and the accompanying drawings, in which.

DETAILED DISCRIPTION OF THE INVENTION

Figure 1:
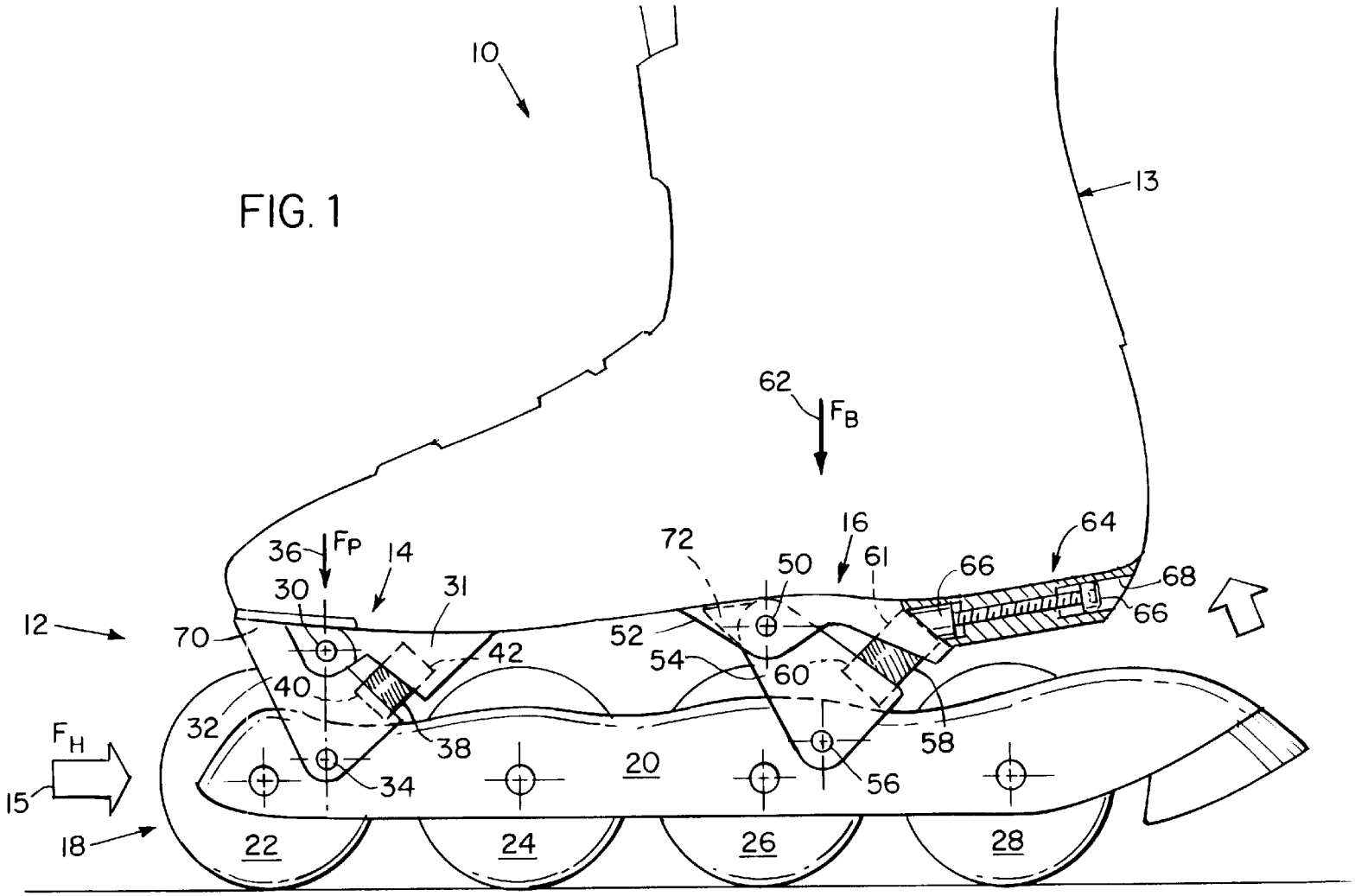
FIG. 1 is a diagrammatic side elevational view of an in-line skate including a skate shoe and a double pivot shock absorber system according to this invention with all the wheels carried by a single truck device.

There is shown in FIG. 1 a roller skate 10 including the roller skate shock absorber system 12 according to this invention attached to a skate shoe 13. Shock absorber system 12 includes two double pivot mechanisms 14 and 16 spaced longitudinally along skate shoe 13 from front to back. Double pivot mechanism 14 is at the forward end of skate shoe 13 while double pivot mechanism 16 is at the rearward portion of skate shoe 13. Double pivot mechanisms have suspended from them truck device 18 which includes a single frame 20 which rotatably mounts a plurality of wheels 22, 24, 26 and 28. Double pivot mechanism 14 includes a first pivot 30 mounted to a bracket 31 on the bottom of skate shoe 13. Pivotably mounted at pivot 30 is pivot member 32 which itself contains a second pivot 34 that is attached to frame 20 of truck device 18.

Note that pivots 30 and 34 are vertically aligned to provide a maximum stiffness for transfer of push-off force $F_p$ as indicated by vector 36. Pivots 30 and 34 are kept vertically aligned by the biasing force of elastomeric shock absorbing material 38, such as neoprene, a polyurethane blend or EVA foam, which extends into a cylindrical recess such as a cup or socket 40 in pivot member 32 and a similar cylindrical recess cup or socket 42 in bracket 31.

Double pivot mechanism 16 also includes a first pivot 50 on bracket 52 to which is rotatably attached pivot member 54. Pivot member 54 contains its own pivot 56 which is rotatably attached to frame 20. In this case the vertical axes of pivots 50 and 56 are not vertically in line. Their position is maintained by elastomeric cylinder 58 which is mounted in cylindrical recess cup or socket 60 in pivot member 54 and a similar recess cup or socket 61 in bracket 52. A downward force, $F_B$, as indicated at vector 62 will cause pivot 56 to rotate up and backward relative to pivot 50 giving a feel of softness and resilience at this part of the skate, while the forward part of the skate feels stiff and is stiff for increased transfer of push-off force because pivots 30 and 34 are vertically aligned. An adjustment mechanism 64 is provided to apply a compression force through piston 66 to elastomeric material 58 by rotating screw 66 accessible in recess 68. The more elastomer 58 is compressed the stiffer will be the response of the suspension conveyed by pivot member 54.

Although only two double pivot mechanisms are shown, more may be employed. At least two are required to implement the four-bar linkage defined by the four pivots 30, 34, 56 and 50 and the four links, pivot member 32, frame 20, pivot member 54 and the base of skate shoe 13 including brackets 31 and 52. Although the adjustment mechanism 64 is shown only with respect to double pivot mechanism 16, it may be used on either mechanism 14 or 16 or both, and if there are more double pivot mechanisms than two it may be used on those as well. Also, other types of adjustment mechanisms may be utilized which will be apparent to those skilled in the art. The vertical alignment of the pivots is shown with respect to the forward pivot mechanism 14 while the rearward pivot mechanism 16 is not vertically aligned but in fact either one or both of them may have their pivots aligned. For example, pivot mechanism 16 may be arranged with its pivots 50 and 56 vertically aligned in addition to pivots 30 and 34 being aligned, or pivots 50 and 56 could be vertically aligned and pivots 30 and 34 not vertically aligned.

While there is an elastomeric member associated with each of pivot mechanisms 14 and 16, this is not a necessary limitation of the invention. There may be simply one elastomeric member regardless of the number of pivot mechanisms, and the elastomeric member need not be disposed strictly between the bottom of skate shoe 13 and the pivot member itself, the one or more elastomeric members used can be placed anywhere between the skate shoe and truck device 18. For example, it could be placed directly between the skate shoe and truck 18. In addition, the elastomeric members need not be rearward of the pivot axes as shown but could be forward of them as well. In addition, the elastomeric members may be substituted with other types of shock absorbing devices such as, for example, mechanical springs or dampers.

Advantageously but not necessarily, at least one of pivot members 32 and 54 may be provided with a stop 70, 72 which limits the forward motion of pivot arms 32 and 54, respectively, and thereby limits the forward motion of truck device 18. Although in FIG. 1 and all the remaining FIGS. 2–7 the invention is shown applied to an in-line skate, this is not a necessary limitation of the invention, as the invention is useful with any roller skate.

Figure 1A:
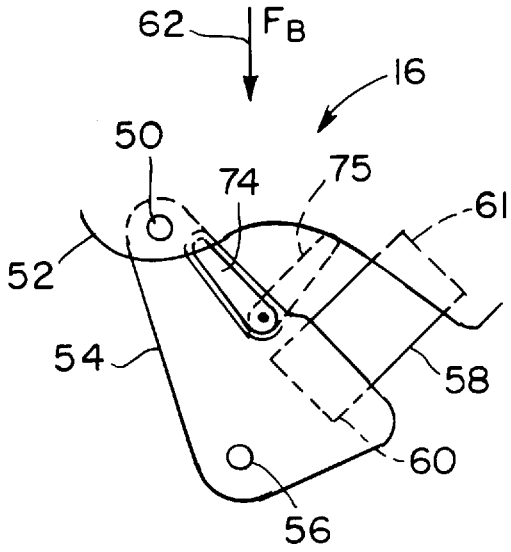
FIG. 1A is a diagrammatic side elevational view of a suspension locking device which may be included on the skate shown in FIG. 1 or any of the other embodiments of FIGS. 2–6.
Figure 1B:
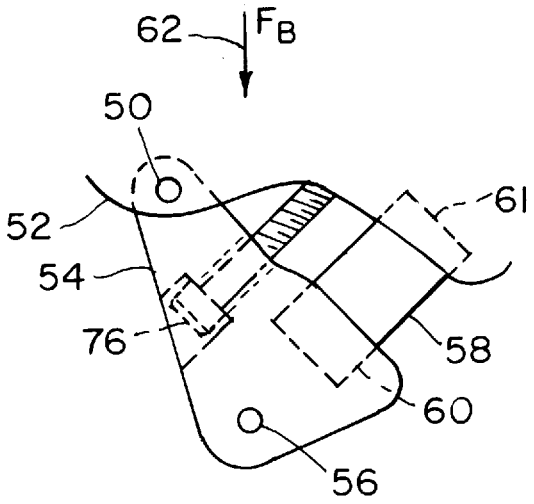
FIG. 1B is a diagrammatic side elevational view of an alternative suspension locking device.

When skating on a very smooth surface such as on a track, for example, it may be desirable to lock out the suspension provided by the pivot member to lock the truck device in a fixed position with respect to the skate shoe. This enables the skate to perform as a normal skate without suspension. The lock out may be accomplished by providing a suspension locking device such as lever 74, FIG. 1A, rotatably affixed to pivot member 54 of double pivot mechanism 16. In the unlocked position elastomeric material 58 compresses when force, $F_B$ 62, causes pivot 56 to rotate up and backward relative to pivot 50, as described above. In the locked position 75 (shown in phantom), 20 lever 74 prevents the rotation of pivot 56 relative to pivot 50 and hence movement of truck device 18 relative to skate shoe 13 under force $F_B$ thereby locking out the suspension. Alternatively, screw 76, FIG. 1B, could be used to lock out the suspension to prevent movement of truck device 18 relative to skate shoe 13. Suspension lock out may be accomplished in a number of other ways which will be apparent to those skilled in the art.

Although the locking device is shown on the rear double pivot mechanism it could be included on the front double pivot mechanism. Also, these suspension locking devices could be provided with any of the other embodiments shown in FIGS. 2–6, described below.

Figure 2:
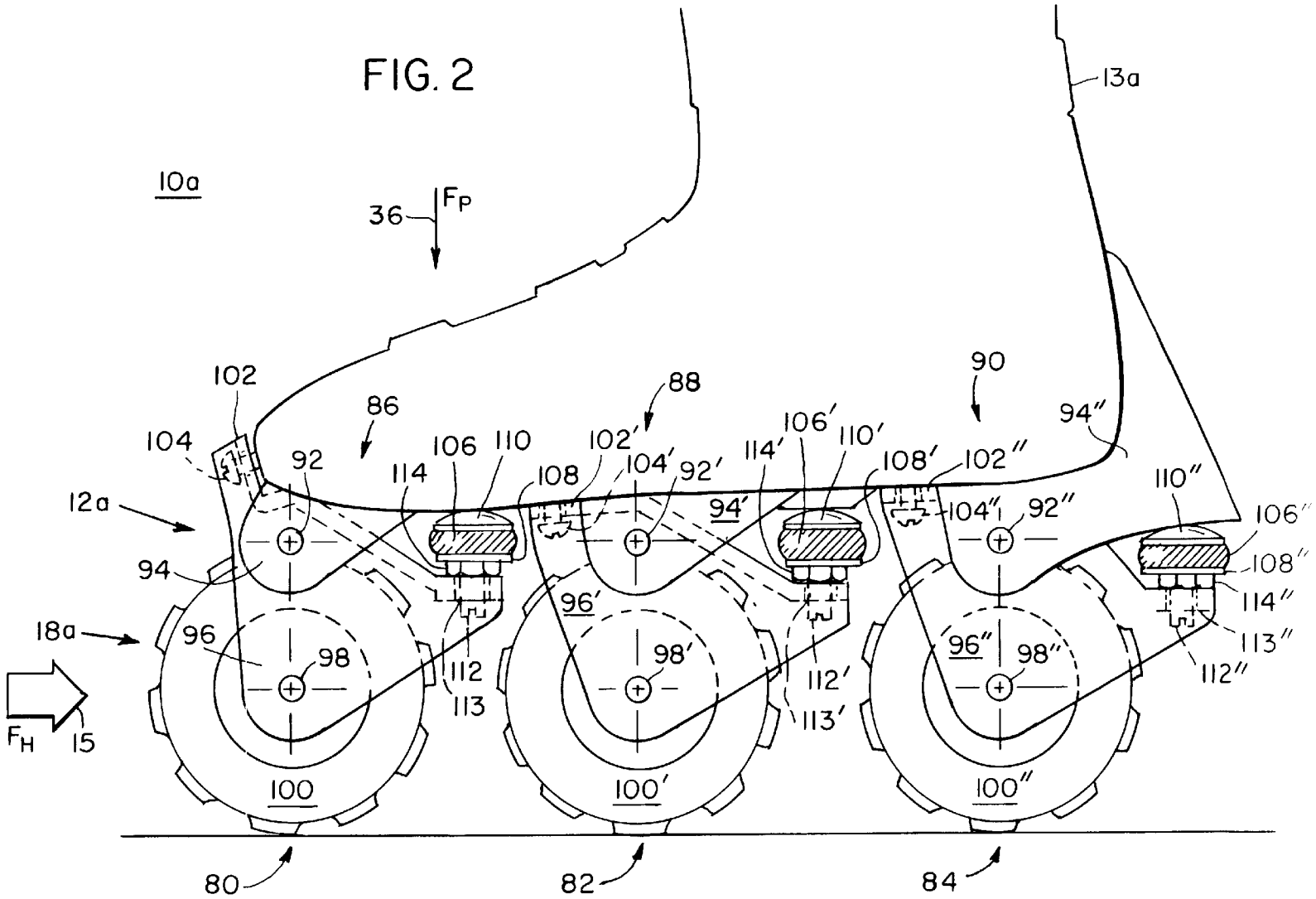
FIG. 2 is a view similar to FIG. 1 in which the truck device includes a number of independent wheel units.

Roller skate 10*a*, FIG. 2, includes skate shoe 13*a* and shock absorber system 12*a* according to this invention in which the truck device 18*a* includes a plurality of independent wheel units 80, 82 and 84, each of which is mounted to the bottom of skate shoe 13*a* by a double pivot mechanism 86, 88 and 90. Double pivot mechanism 86 includes first pivot 92 on bracket 94 and pivot member 96 rotatably attached to pivot 92. Pivot member 96 includes second pivot 98 which also serves as the axis for wheel 100. Pivot axes 92 and 98 are vertically aligned. Pivot member 96 includes a stop 102 which is adjustable by means of screw 104. Elastomeric material 106 is sandwiched between flat washer 108 and domed washer 110 to provide both shock absorbing and the biasing force to keep pivot axes 92 and 98 aligned. For this purpose elastomeric member 106 is mounted on a threaded screw 112 engaged in threaded bore 113 by which it may be adjusted vertically to set the space between the bottom of skate shoe 13*a* and member 96. The vertical spacing between the bottom of skate shoe 13*a* and member 96 may be adjusted in a variety of ways which will be apparent to those skilled in the art. There is also included a compression nut 114 on threaded screw 112 which can be tightened or loosened to increase or decrease, respectively, the compression of elastomeric member 106 and thereby increase or decrease its stiffness. Pivot mechanisms 88 and 90 are constructed similarly to pivot mechanism 86 as indicated by like numbers primed and double primed being applied to like parts. A force F downward on any part of the skate shoe will provide a stiff feeling because of the vertical alignment of axes 92 and 98, axes 92' and 98', and axes 92" and 98", but should an impact force $F_H$ indicated by vector 15 occur at front wheel 100, it and successively the other wheels 100' and 100" will rock backward and upwardly to absorb the shock.

Figure 3:
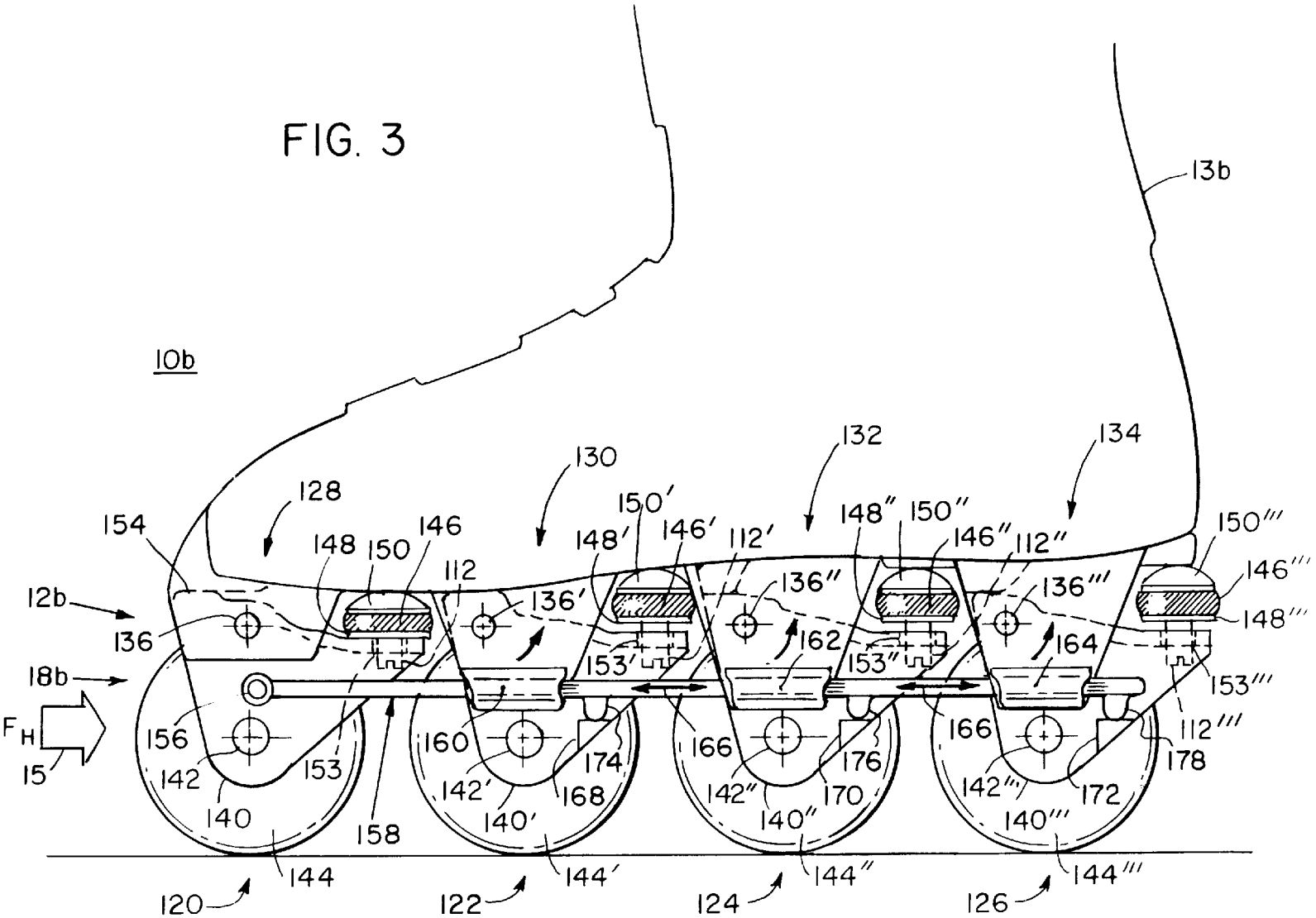
FIG. 3 is a view similar to FIG. 2 including an automatic mechanism for switching from a stiffer to a more shock absorbing arrangement.

A shock absorber system 12*b*, FIG. 3, which normally retains a stiff suspension but quickly shifts to a resilient suspension in order to absorb the shock upon an impact from a rough surface and which can then return to the stiff suspension configuration is shown in FIG. 3. Here again truck 18*b* includes a plurality of independent wheel units 120, 122, 124 and 126, each of which is connected to the bottom of skate shoe 13b by a double pivot mechanism 128, 130, 132 and 134, respectively. Double pivot mechanism 128 includes a pivot 136 on bracket 138, and pivot member 140 which is rotatably attached to pivot 136 and carries its own second pivot 142 which also acts as the rotational axis for wheel 144. Elastomeric member 146 is captured between flat washer 148 and domed washer 150 and is adjustably mounted on pivot member 140 by means of threaded screw 152 and threaded bore 153. Pivot member 140 again includes a stop 154 which limits the forward motion or clockwise rotation of pivot member 140. Pivot member 140 also contains a third pivot 156 to which is pivotably attached control link 158.

Double pivot mechanisms 130, 132 and 134 are all constructed similarly to double pivot mechanism 128 with the exception that they do not contain the third pivot 156 to mount control link 158. Rather, each of them has a guide 160, 162, 164 that allows control link 158 to slide to and from as indicated by the double-headed arrows 166. In pivot mechanisms 130, 132 and 134, like parts have been given like numbers with respect to pivot mechanism 128 accompanied by single, double and triple primes, respectively. Each of pivot mechanisms 130, 132 and 134 contains a pivot lock 168, 170, 172 on its pivot arms 140', 140", 140'" which is not present on pivot member 140 of pivot mechanism 128. These pivot locks 168, 170, 172 engage with salient detents 10 174, 176 and 178 on control link 158. Thus in the position shown, axes 136 and 142 of pivot mechanism 128 are vertically aligned and would give a stiff feel to the suspension. However, pivot axes 136', 142', 136", 142", 136'", 142'" are not vertically aligned and would ordinarily provide a soft suspension. However, because detents 174, 176 and 178 are constrained by pivot locks 174, 176 and 178, double pivot mechanisms 130, 132 and 134 also provide a stiff suspension.

But if a force $F_H$, vector 15, should impact front wheel 144, this would rock pivot member 140 backward and upwardly. This would drive each of detents 174, 176 and 178 rearwardly off of pivot locks 168, 170 and 172 so that each of the wheels 144', 144" and 144'" would be free to resiliently respond. As the skater continues to skate 20 and unweights the skate, the force of the resilient elastomeric members 146", 146" and 146'" would push down on wheels 144', 144" and 144'" and elastomeric member 146 would rock arm 144 forward so that control link 158 would be drawn forward once again and detents 174, 176 and 178 would reengage with pivot locks 168, 170 and 172. Further, the suspension locking device of FIGS. 1A and 1B may be used to cause the suspension to remain stiff should the user choose.

Figure 4:
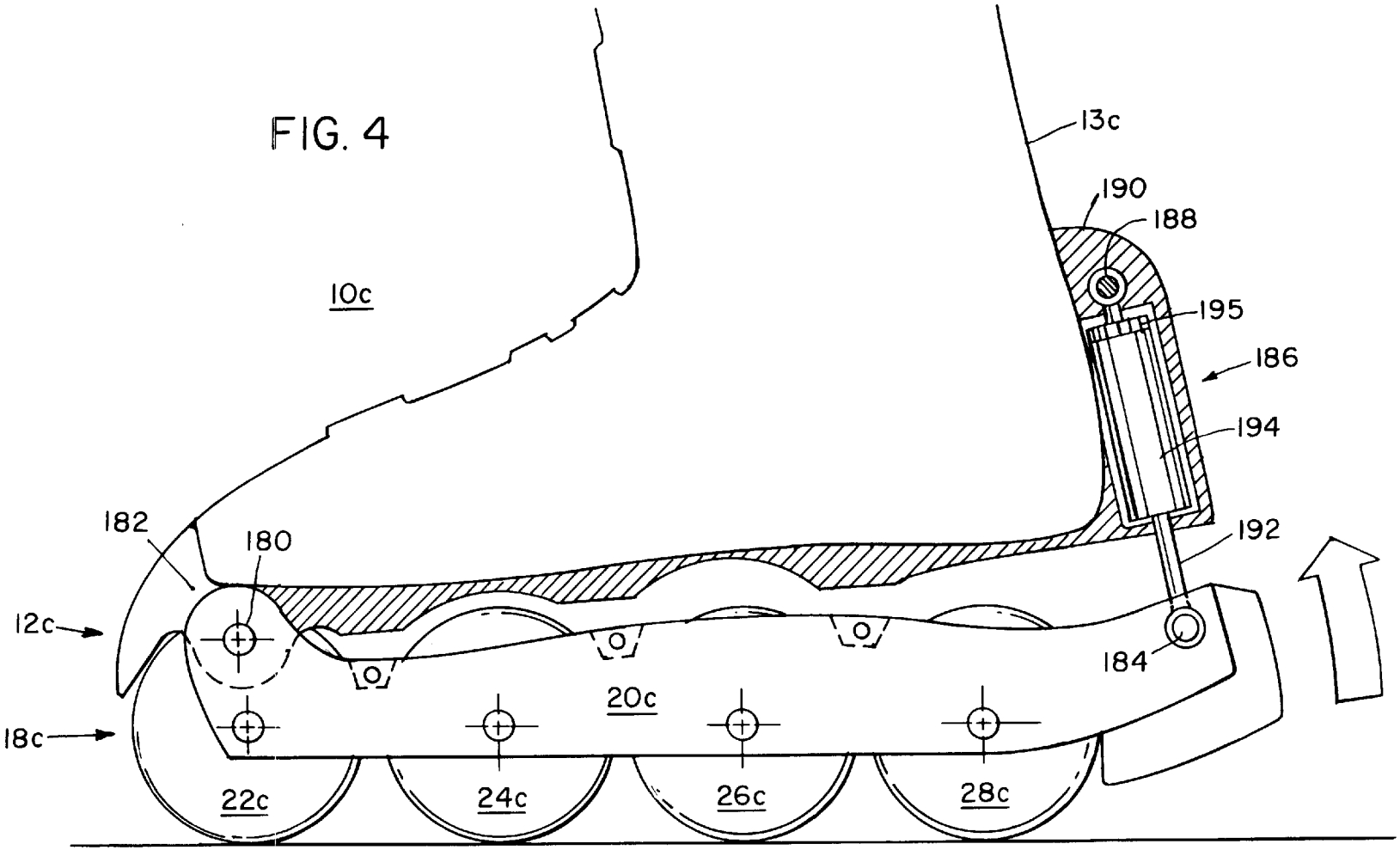
FIG. 4 is a diagrammatic side elevational view of a skate shoe and a single pivot shock absorber system according to this invention with the shock absorber mounted at the back of the skate shoe.

Roller skate 10*c*, FIG. 4, includes a shock absorber system 12*c* according to this, invention in which truck 18*c* includes frame 20*c* which rotatably mounts a plurality of wheels 22*c*, 24*c*, 26*c* and 28*c*. Here frame 20*c* is pivotally attached at a single pivot 180 to a bracket 182 at the forward portion of skate shoe 13*c*. At the rearward portion of frame 20*c* there is pivotally attached at pivot 184 a shock absorber 186 whose other end is attached to pivot 188 on a bracket 190 at the back of skate shoe 13*c*. Shock absorber 186 includes a rod or piston 192 and a cylinder 194 which may be filled with an elastomeric material, oil or some similar well-known shock absorber arrangement. A shock adjustment control such as knob 195 may be used to vary the stiffness of shock absorber 186. System 12*c* also provides a stiffness beneath the forward portion for a strong, efficient push-off and shock absorption through the facilities of shock absorber 186.

Figure 5:
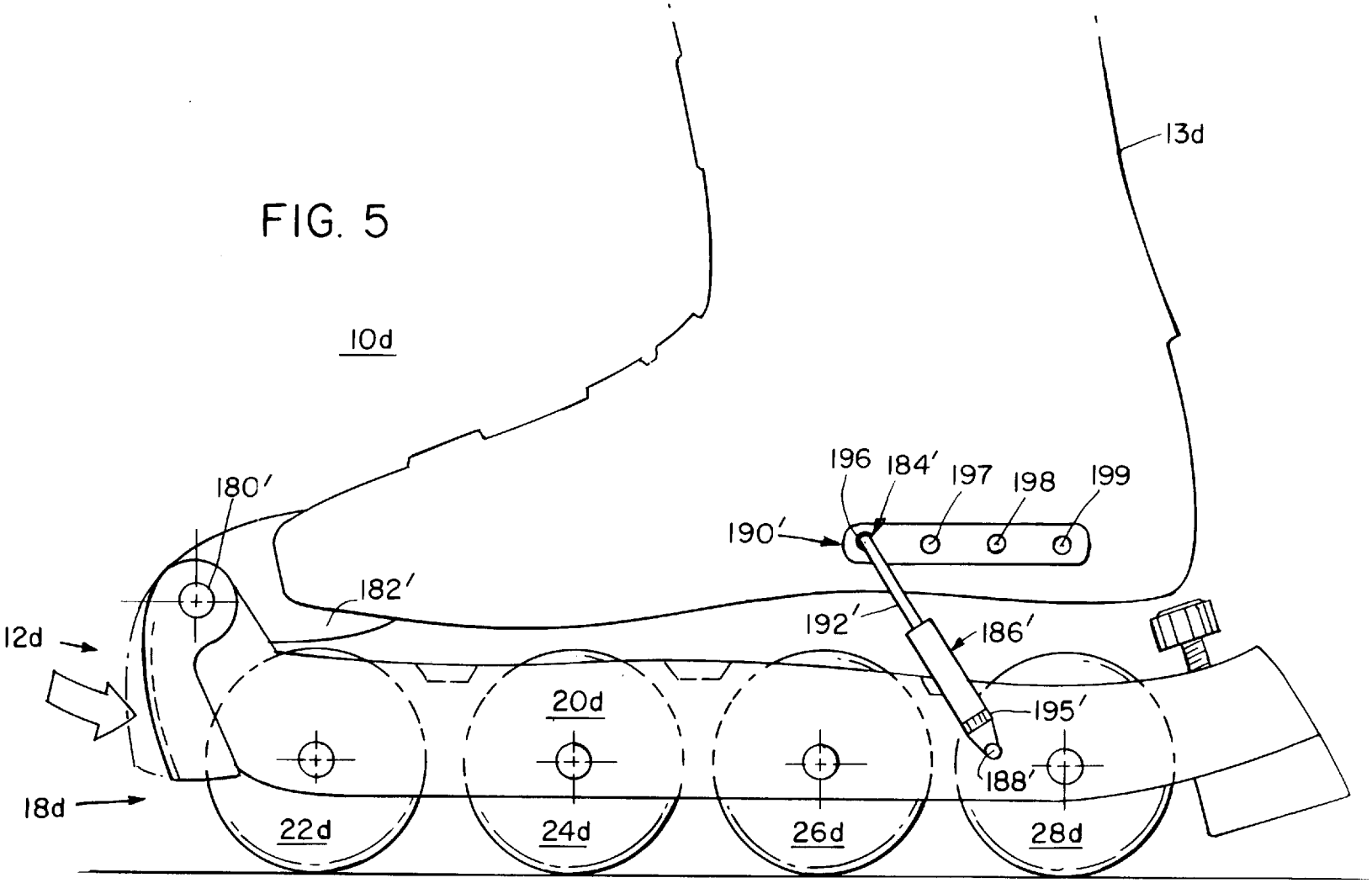
FIG. 5 is a view similar to FIG. 4 with the shock absorber attached to the underside of the skate shoe and angled from the truck device upwardly and adjustable forwardly, vertically or rearwardly.
Figure 6:
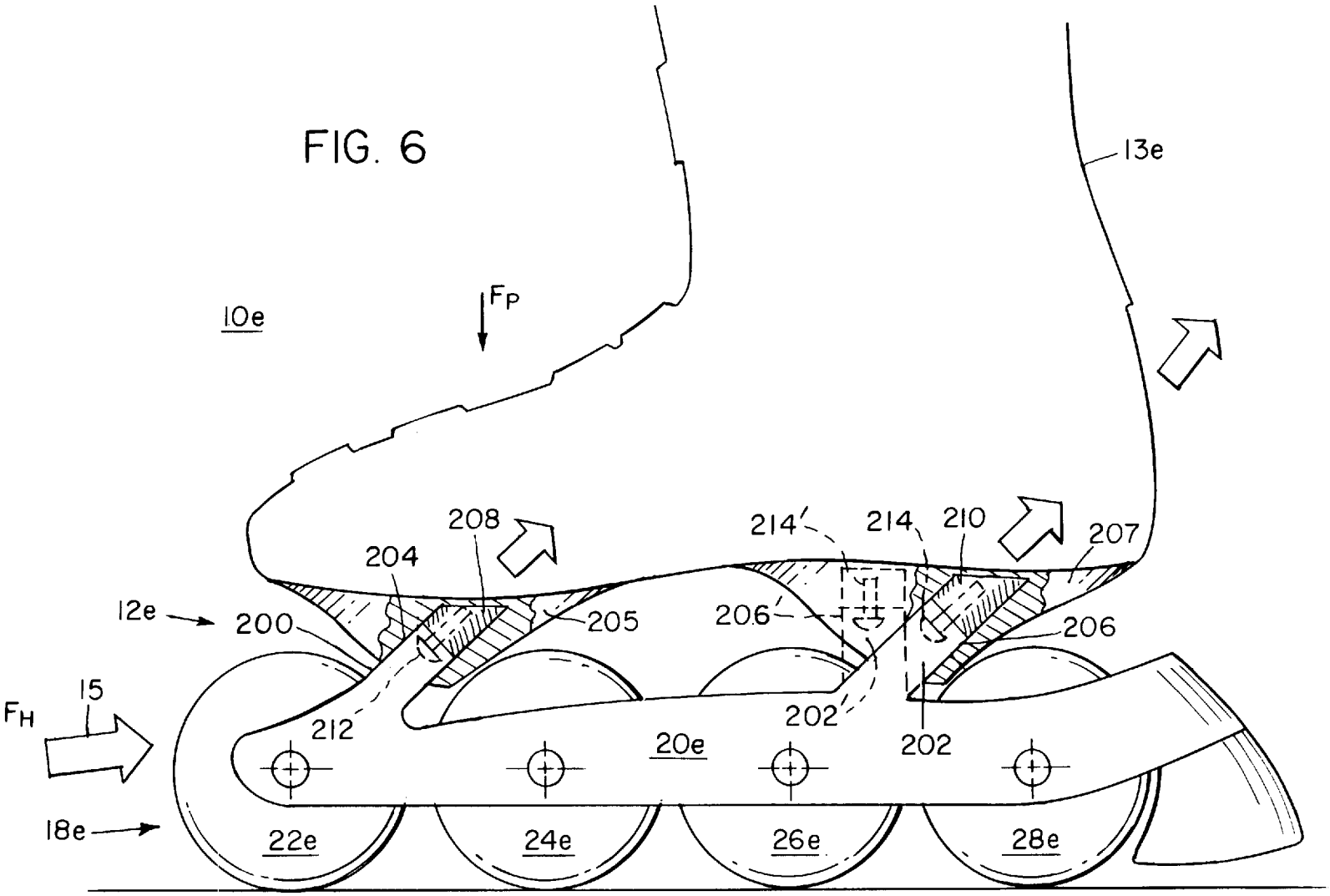
FIG. 6 is a diagrammatic side elevational view of a skate shoe with a sliding rather than a pivoting shock absorbing system according to this invention.

A similar construction is shown in FIG. 5, but here shock absorber 186' is attached more forwardly on frame 20*d* as compared with the embodiment of FIG. 4. Also, pivot 184' of shock absorber 186' may be adjustably affixed to bracket 190' at a number of pivot point locations 196–199 to vary the stiffness of the suspension. As the pivot point is moved from locations 196 to 199 toward the rear of skate shoe 13d the stiffness of the suspension increases. Shock absorber 186' may be angled forwardly at locations 196 and 197, vertically at location 198, and rearwardly at location 199. Of course, various numbers of pivot point locations may be utilized. This also allows some vertical deflection to be caused by the front wheel as the pivots are not aligned.

An even simpler construction is shown in FIG. 7, where a truck device includes two upstanding elements 200 and 202 which extend upwardly and rearwardly with respect to frame 20*e* into holes or sockets 204, 206 in mounts 205 and 207 in which is disposed elastomeric material 208, 210. Elements 200 and 202 are fixed to the elastomeric material by retaining screws 212 and 214. In this way any shock imparted by force $F_H$ 15 is absorbed upwardly and rearwardly by elastomeric materials 208 and 210 while maintaining some stiffness when subjected to a downward force $F_P$ during push-off depending on the chosen angle of the tracks. Alternatively, elements 200 and 202 may be configured to extend vertically upward as shown in phantom as element 202' which extends into socket 206' in mount 207. Within mount 202 is disposed elastomeric material 210'. Element 202' is affixed to elastomeric material 210' by retaining screw 214'. A vertically upwardly extending element corresponding to element 200 is not shown in this figure for the sake of clarity.

Retaining screws 212 and 214 through the elastomeric material may also be used to adjust the stiffness and travel of the suspension. Further, elastomeric material 208,210 may be easily replaced with softer or harder materials to optimize the suspension feel.

In any of the embodiments described above, there may be provided a vertical adjustment for the front wheel to allow the wheel to be raised and lowered. This enables the user to adjust the clearance height of the skate. On rough terrain the front wheel would be raised to allow the skate to pass over larger obstacles.

Although specific features of this invention are shown in some drawings and not others, this is for convenience only as each feature may be combined with any or all of the other features in accordance with the invention.

Other embodiments will occur to those skilled in the art and are within the following claims:

What is claimed is:

1. A roller skate shock absorber system comprising:

at least two mounting mechanisms spaced longitudinally from front to back along a skate shoe; and a truck device including a plurality of wheels;

at least one said mounting mechanism including a first mounting member on the skate shoe and a second mounting member on the truck device and a shock absorber member interposed between said first and second mounting members for absorbing shocks imparted to the wheels of said truck device, one of said first and second mounting members including a salient element and the other a socket, said shock absorber member disposed between the distal end of said element and the closed end of said socket.

2. The roller skate shock absorber system of claim 1 in which said first and second mounting members are angled vertically upwardly and rearwardly.

3. The roller skate shock absorber system of claim 1 in which said first and second mounting members are angled vertically upwardly.

4. The roller skate shock absorber system of claim 1 in which said shock absorber member is an elastomeric medium.

5. The roller skate shock absorber system of claim 1 in which said truck device includes a frame and a plurality of wheels rotatably mounted on said frame.

6. The roller skate shock absorber system of claim 5 in which said wheels are arranged longitudinally in-line.

7. The roller skate shock absorber system of claim 1 further including an adjustment mechanism associated with said shock absorber member for varying the stiffness response of said shock absorber member.

8. The roller skate shock absorber system of claim 1 further including locking means, selectively actuable, for locking said truck device in a fixed position with respect to said skate shoe.

9. A roller skate shock absorber system comprising:

a forward mount attached to a skate;

a rearward mount attached to the skate;

a truck device including a plurality of in-line wheels;

a forward double pivot mechanism connecting said truck device to said forward mount; and a rearward double pivot mechanism connecting said truck device to said rearward mount forming a four-bar linkage wherein the forward mount, the skate, and rearward mount form a first bar; the forward double pivot mechanism forms a second bar; the rearward double Divot mechanism forms a third bar; and the truck device forms a fourth bar of the four-bar linkage.

10. A roller skate shock absorber system comprising:

a forward mount attached to a skate;

a rearward mount attached to the skate;

a truck device including a plurality of in-line wheels;

a forward double pivot mechanism connecting said truck device to said forward mount; and means for connecting said truck device to said rearward mount forming a four-bar linkage wherein the forward mount, the skate, and rearward mount form a first bar; the forward double pivot mechanism forms a second bar; the means for connecting forms a third bar; and the truck device forms a fourth bar of the four-bar linkage.

* * * * *